US007658199B2

(12) United States Patent
Ayers et al.

(10) Patent No.: US 7,658,199 B2
(45) Date of Patent: Feb. 9, 2010

(54) WORK CUBICLE COVER

(76) Inventors: Ronald Lee Ayers, 364 Beemer Ave., Sunnyvale, CA (US) 94086; Ada Marie Bull, 324 Angel Ave., Sunnyvale, CA (US) 94086

( * ) Notice: Subject to any disclaimer, the term of this patent is extended or adjusted under 35 U.S.C. 154(b) by 163 days.

(21) Appl. No.: 11/145,516

(22) Filed: Jun. 3, 2005

(65) Prior Publication Data

US 2006/0283111 A1 Dec. 21, 2006

(51) Int. Cl.
*E04H 15/00* (2006.01)

(52) U.S. Cl. ..... 135/87; 135/117; 135/151; 135/155; 135/143

(58) Field of Classification Search ..... 52/3, 52/23, 36.2, 239; 135/117, 87, 151, 154, 135/155, 143, 147, 97, 88.1, 88.12, 90, 96, 135/119; 312/223.3, 3, 249.8, 329; 296/295.1; 160/76

See application file for complete search history.

(56) References Cited

U.S. PATENT DOCUMENTS 2,159,273 A * 5/1939 Killinger ..... 135/125
2,599,066 A * 6/1952 Osborn ..... 160/370.21
2,619,919 A * 12/1952 Dvorkin ..... 52/3
3,042,053 A * 7/1962 Gabriel ..... 135/130
3,105,505 A * 10/1963 Maybee ..... 135/135
3,525,290 A * 8/1970 Pelsue ..... 135/126
3,968,809 A * 7/1976 Beavers ..... 135/88.14
4,819,680 A * 4/1989 Beavers ..... 135/125
5,024,262 A * 6/1991 Huang ..... 160/370.21
5,135,281 A * 8/1992 Pappalardo ..... 297/184.15
5,137,044 A * 8/1992 Brady ..... 135/126
5,511,254 A * 4/1996 O'Brien ..... 4/532
5,603,343 A * 2/1997 Larson ..... 135/131
5,628,338 A * 5/1997 Stumbo ..... 135/147
5,638,642 A * 6/1997 Nemec ..... 52/3
5,638,850 A * 6/1997 Hazinski et al. ..... 135/120.1
5,802,778 A * 9/1998 Thorp et al. ..... 52/36.2
5,845,697 A 12/1998 Zheng
5,927,793 A * 7/1999 McGrath, Jr. ..... 296/136.13
6,048,044 A * 4/2000 Biggel et al. ..... 312/258
6,053,588 A * 4/2000 Biggel et al. ..... 312/249.8
6,123,223 A * 9/2000 Watkins ..... 221/121
6,131,218 A * 10/2000 Wang ..... 5/93.1
6,494,335 B1 * 12/2002 Kellogg et al. ..... 220/9.3
6,615,550 B2 * 9/2003 Reuschel et al. ..... 52/36.2
6,948,632 B2 * 9/2005 Kellogg et al. ..... 220/9.4

* cited by examiner

*Primary Examiner*—Richard E Chilcot, Jr.
*Assistant Examiner*—Chi Q Nguyen
(74) *Attorney, Agent, or Firm*—Schneck & Schneck; David M. Schneck

(57) ABSTRACT

A work cubicle cover is described, designed to be positioned between one or more light fixtures providing room lighting in a human work space defined by a cubicle in the room. The cover is made up of a pliable sheet of mesh screen held in position over the work cubicle by the interaction of a spring wire construction which provides its support with the partitions defining individual cubicles in the room. The spring wire construction enables the work cubicle cover to be coiled when not in use.

8 Claims, 2 Drawing Sheets

WORK CUBICLE COVER

BACKGROUND OF THE INVENTION

This invention relates to a work cubicle cover to reduce interference of room lighting with the work space in the cubicle and, more particularly, to such a work cubicle work cover which is simple and yet effective and collapsible.

Many rooms providing work spaces for humans are divided by partitions into work cubicles, the partitions for which do not extend fully to the room ceiling. Each of these individual cubicles often includes both a built-in desk providing a horizontal work space and a door.

As mentioned above, the partitions do not extend fully to the ceiling. Moreover, a multiple number of cubicles are provided in each work room. The result is that the room lighting, typically provided by fluorescent light fixtures, provides lighting for a multiple number of work cubicles. This lighting often is found by the workers themselves to be glaring in their work space, particularly if the work space includes a computer and accompanying computer screen.

SUMMARY OF THE INVENTION

The present invention is a work cubicle cover designed to obviate the above problem. In this connection, it is designed to be positioned between one or more light fixture providing the room lighting and a human work space defined by a cubicle in the room. In its basic aspects, each cubicle cover comprises a body of light interacting material, such as a glare reducing material, and a support structure for holding the light interacting material in position between the light fixtures and the human work space.

Most simply and effectively, the light interactive material is a pliable sheet of mesh screen held in position over a work cubicle by interaction of its support structure with the partitions defining the individual cubicles. This support structure desirably includes a peripheral support made up of a spring wire construction which enables the work cubicle cover to be collapsed as a single unit. The result is that the cubicle cover easily can be coiled for collapsing as will be described.

Other aspects of the invention either will become apparent or will be described in connection with the following, more detailed description of a preferred embodiment of the invention and variations.

BRIEF DESCRIPTION OF THE DRAWINGS

With reference to the accompanying two sheets of drawing.

DETAILED DESCRIPTION OF THE PREFERRED EMBODIMENT

The following, relatively detailed description is provided to satisfy the patent statutes. It will be appreciated by those skilled in the art, though, that various changes and modifications can be made without departing from the invention.

Figure 1:
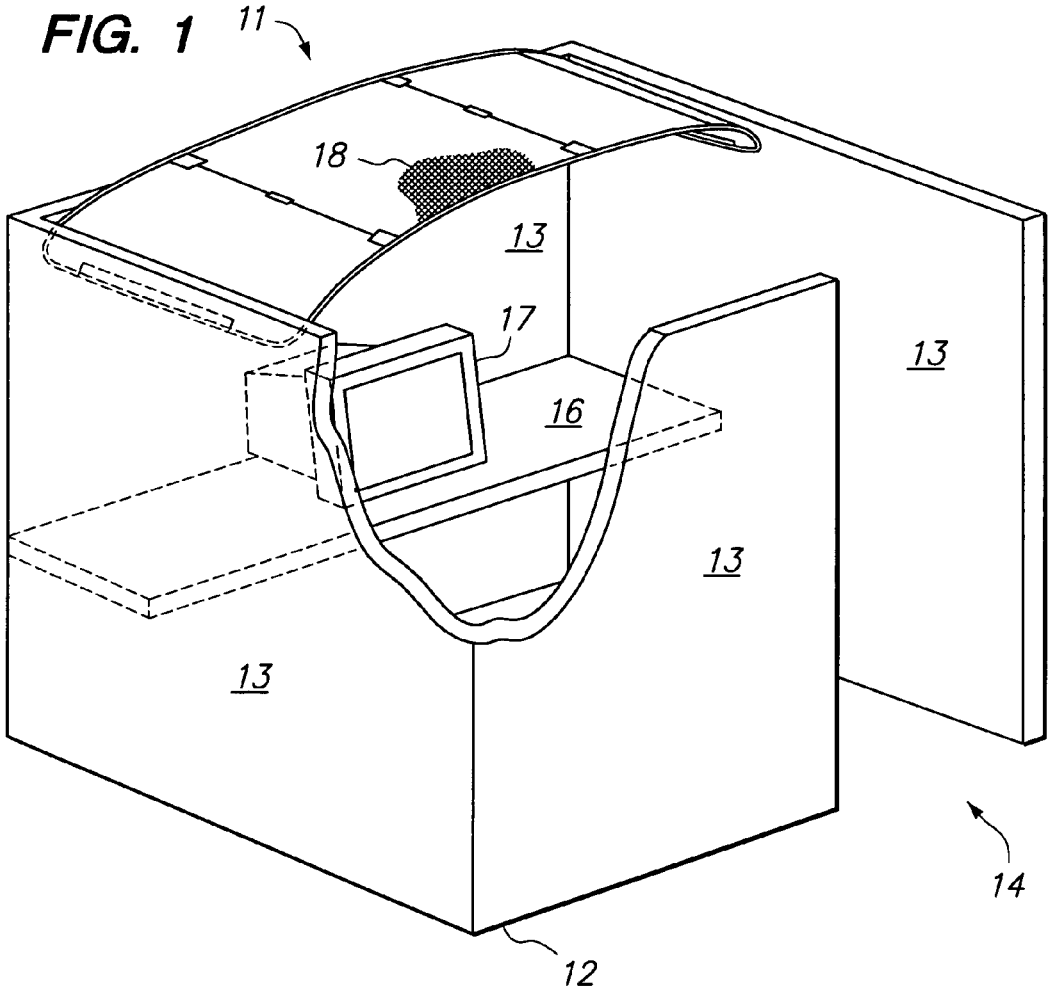
FIG. 1 is an isometric and partially broken away view of an individual work cubicle showing a preferred embodiment of the invention interacting therewith.

A preferred embodiment of the invention is generally referred to by the reference number 11, which preferred embodiment is shown in FIG. 1 interacting with a standard work cubicle 12. Cubicle 12 is typical in that it is made up of partitions 13 which do not extend to the ceiling of the room in which such work cubicle is located. Generally a plurality of the work cubicles are incorporated into a single work room and, in this connection, the partitions are often part of adjacent work cubicles. Although most of the details of the work cubicle are not relevant and therefore are not illustrated, this typical work cubicle includes a door area 14 and a horizontal work space 16 (a desk).

The problem to which the present invention is directed is that often the room lighting provides a glare (due often to reflection) off of the horizontal work space and the equipment thereon in the individual cubicles. This room lighting is typically supplied by fluorescent lighting provided to illuminate the full room. The problem of glare is particularly acute when the equipment on the horizontal work space includes a visual screen, such as a computer screen.

The preferred embodiment of the invention is designed to alleviate this problem. The cover of the invention is designed to be positioned between the room light fixtures (not shown) and the horizontal human work space. The main operative portion of the cover is a body of light interacting material, especially a glare reducing material. This material is most desirably a pliable sheet of material provided simply as a mesh screen 18 (partially shown) of the type typically found in screen windows and doors. This mesh screen transmits some of the room light but yet cuts or diffuses the same to reduce its glare on the work space 16 and any equipment, etc., on the same. In this preferred embodiment, the light interacting material is the shade material having a 60 percent shade value, sold under the trademark Shade-Rite, by Green-Tek, Inc., of 407 North Main Street, Edgerton, Wis. 53534. The nominal hole size is 0.2 inches by 0.08 inches.

It will be appreciated that although only shown partially, the screen 18 fills in the full portion of the cubicle cover surrounded by the peripheral sleeve 19, to be described in more detail hereinafter.

Figure 5:
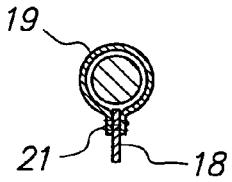
FIG. 5 is a highly enlarged view taken on a plane indicated by the line 5-5 in FIG. 4, showing a peripheral sleeve of the preferred embodiment of the invention housing an edge portion of the support structure.

The cubicle cover also includes a support structure for holding the screen in position between the light fixtures and the human work space. This support structure includes a peripheral spring wire circumscribing the screen 18 which, as is best illustrated in FIG. 5, is housed within a sleeve 19. In this connection, sleeve 19 is secured to the edge of the screen 18 by stitching 21 or other appropriate means.

Figure 4:
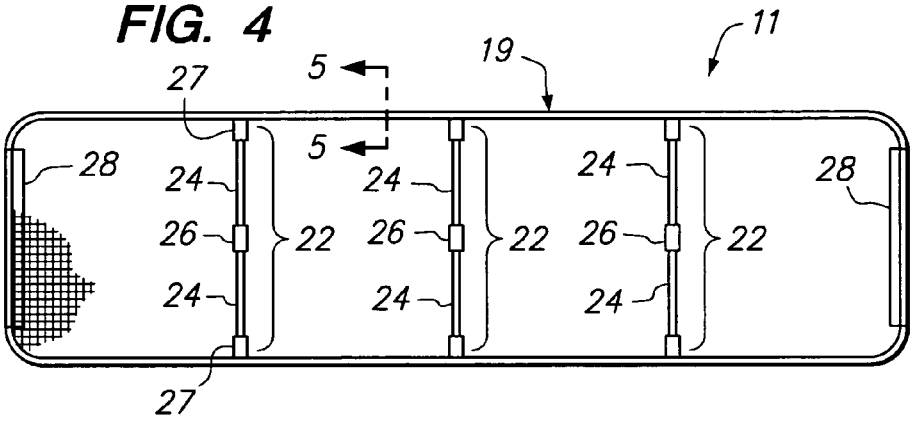
FIG. 4 is a plan view showing the preferred embodiment of the invention.

As best illustrated in FIG. 4, the support structure also includes periodically placed cross support structures in the form of spring rods 22. Each support rod is made up of a pair of spring rod pieces 24 which are aligned with their adjacent ends connected by a sleeve connector 26. While not shown it will be appreciated that the adjacent pieces 24 are hollow and have a spring cord connecting the same similar to structures found in tent poles, so that they are held together and yet can be separated at the connectors 26. To be secured in place stretching out the cubicle cover as illustrated, the opposed ends of each spring rod 22 fits within opposed pockets 27 sewn or otherwise secured to the sleeve 19.

The support structure also includes at each of its opposed ends a fastener for securing the same between the partitions 13 of the work cubicle. In this connection, strips 28 of one-half of a loop-pile securing system of the type sold with the trademark "Velcro" by Minnesota Mining and Manufacturing Company of Minneapolis, Minn. are adhered at the opposed ends of the cubicle cover. Most desirably, the half of the fastening system adhered to the opposed ends of the cover is the loop portion of the loop-pile securing system which in some instances will interact with the pile already provided by the partitions of some cubicles without the necessity of the other half of the fastening system being adhered to the top portions of the cubicle.

As is best illustrated in FIG. 1, the length of the cubicle cover is slightly greater than the distance between the opposed partition walls 13, with the result that because of the spring wire, the cover forms a slight arc over the work space. The spring wires will actually urge the ends of the cover toward the partition walls, thereby helping to maintain the cover in place.

Figure 2:
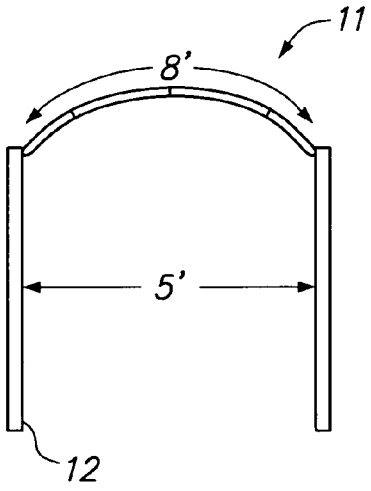
FIGS. 2 and 3 are schematic side sectional views illustrating the manner in which the preferred embodiment of the invention interacts with differently sized cubicles.
Figure 3:
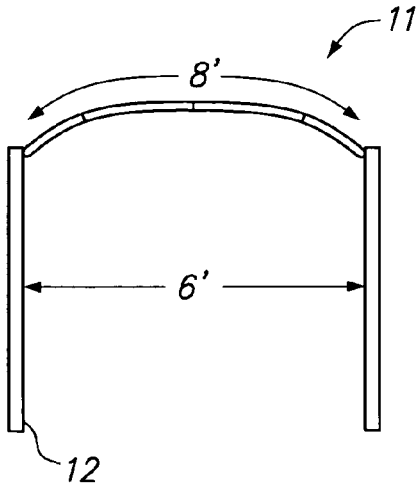

The cover of the invention is designed to be used with cubicles of various dimensions. This is illustrated in FIGS. 2 and 3. The embodiment of the invention being described was eight feet long to interact easily with cubicles which are either five-foot or six-foot wide. As is seen by comparing the two figures, because the spring wire is pliable and yet resilient, the arc created by the side spring wire in the cover is greater with a five-foot-wide cubicle than a six-foot-wide cubicle but in both instances, the eight-foot-long cover spans between the opposed partition walls to maintain the cover in place.

Figure 6:
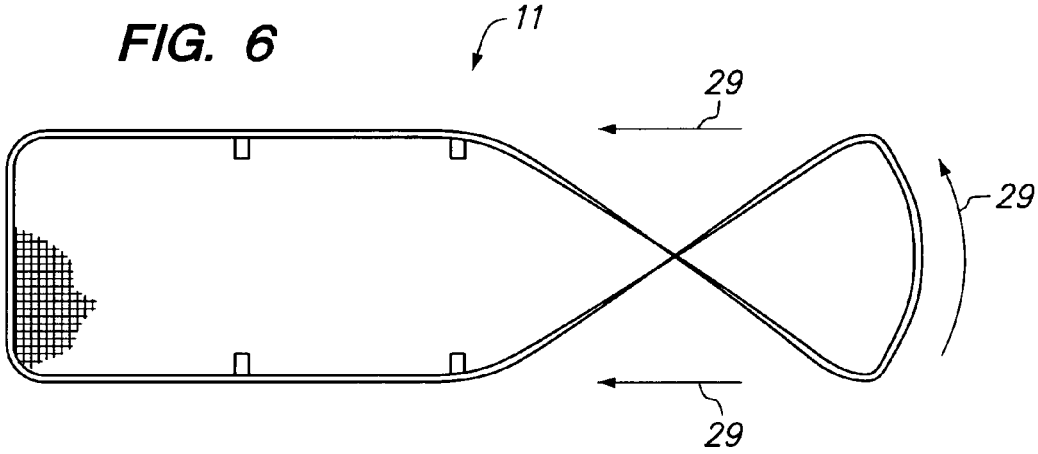
FIG. 6 is another plan view of the preferred embodiment with a portion of the support structure removed and indicating how the preferred embodiment is collapsible.
Figure 7:
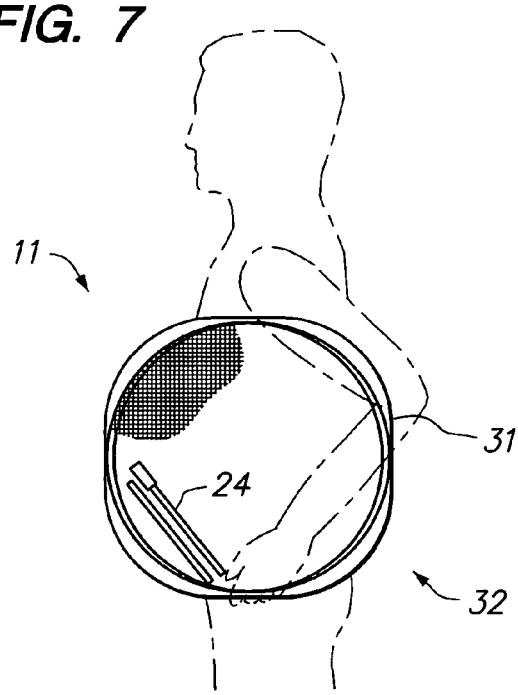
FIG. 7 is another view of the preferred embodiment in its collapsed position.

In this embodiment, the spring wire was selected to be of the type typically found in automobile window shades and the like to enable the cover to be simply collapsed by coiling once the cross supports 22 are removed. This is best illustrated in FIG. 6. For collapsing, the cover is twisted and coiled as is represented by the arrows 29 to form a cylindrical bundle which can be placed within a bag 32 as illustrated in FIG. 7 with the dismantled cross pieces 24 forming a bundle for easy storage.

The simplicity and yet effectiveness of the invention is apparent from the above description of a preferred embodiment. As mentioned at the beginning of the detailed description, though, applicant is not limited to this specific embodiment. For example, other embodiments may be designed to shield a plurality of work cubicles from the lighting in a single room. In such an arrangement, the support structure will be different than that incorporated into this embodiment. The claims, their equivalents, and their equivalent language define the scope of protection.

What is claimed is:

1. A cubicle cover comprising:

a body of light modulating material having a first end edge and a second end edge;

a support structure, the support structure being a spring support, secured to said body of light modulating material as a continuous peripheral edge support and configured to secure said light modulating material such that said light modulating material can shade a work cubical work space, said support structure including a plurality of cross support;

wherein said cross supports are removable; and first and second fasteners on said first and second end edge of said light modulating material, configured to allow attachment and manual detachment of said light modulating material to two cubicle walls.

2. The cover of claim 1, wherein said support structure forms an arc.

3. The cover of claim 1, further including a shoulder bag, wherein said spring support can be bent into a cylindrical structure for transport and storage.

4. The cover of claim 1, wherein said body of light modulating material is shade material.

5. A cubicle cover comprising:

a spring frame forming a continuous perimeter having a length dimension and a width dimension;

a sheet of pliable, glare-reducing material, said sheet having a continuous edge secured to said frame;

a plurality of removable cross supports extending across a width dimension of said spring frame; and fasteners positioned on opposing ends of said sheet, said fasteners configured to allow said cover to be mounted onto an upper wall of a cubicle.

6. The cover of claim 5, wherein said glare reducing material has a 60% shade value.

7. The cover of claim 5, wherein said fasteners are loop material that are a loop portion of a loop-pile securing system, said fasteners extending across opposing ends of said sheet across said width dimension.

8. A portable cubical cover device comprising:

a coilable spring frame forming a continuous perimeter having a length dimension and a width dimension;

a sleeve enclosing said spring frame;

a sheet of pliable, glare reducing material attached to said sleeve;

a plurality of removable cross supports extending across a width dimension of said spring frame;

fasteners positioned on opposing ends of said sheets, said fasteners configured to allow said cover to be mounted onto an upper wall of a cubicle; and a shoulder bag configured to hold cross supports and said frame having said sheet retained on said frame, wherein said frame is coilable into a cylindrical structure for transport and storage.

* * * * *